United States Patent [19]

Besnier

[11] Patent Number: 4,792,155

[45] Date of Patent: Dec. 20, 1988

[54] SAFETY BINDING APPARATUS FOR MONOSKIS

[75] Inventor: Bertrand Besnier, Annecy, France

[73] Assignee: Salomon S. A., Annecy, France

[21] Appl. No.: 23,704

[22] Filed: Mar. 9, 1987

[30] Foreign Application Priority Data

Mar. 10, 1986 [FR] France ..... 86 03854

[51] Int. Cl.[4] ..... A63C 9/00

[52] U.S. Cl. ..... 280/607; 280/12 H; 280/605; 280/618

[58] Field of Search ..... 280/607, 605, 611, 618, 280/617, 633, 12 H, 636; 441/70

[56] References Cited

U.S. PATENT DOCUMENTS

| | | | |
|---|---|---|---|
| 3,802,714 | 4/1974 | Freegard | 280/607 |
| 3,947,049 | 3/1976 | Pederson | 280/607 |
| 4,022,491 | 5/1977 | Powell | 280/607 |
| 4,483,551 | 11/1984 | Beyl et al. | 280/605 |

FOREIGN PATENT DOCUMENTS

| | | |
|---|---|---|
| 2222636 | 11/1973 | Fed. Rep. of Germany . |
| 2494591 | 5/1982 | France . |
| 2536666 | 6/1984 | France . |

*Primary Examiner*—Richard A. Bertsch

*Attorney, Agent, or Firm*—Sandler & Greenblum

[57] ABSTRACT

Adaptor element for a monoski safety binding comprising means for simultaneously releasing two ski boots from a binding system. The adaptor element may be used in conjunction with a binding system, as well as a brake assembly.

42 Claims, 4 Drawing Sheets

SAFETY BINDING APPARATUS FOR MONOSKIS

BACKGROUND OF THE INVENTION

1. Field of the Invention

The present invention relates to safety bindings for monoskis adapted to maintain two boots on a monoski.

2. Background Material and Relevant Information

Safety bindings are known, for example, "front abutment" bindings, which are adapted to assure the immobilization of the front portion of a boot on a ski, as well as bindings known as "rear abutment" bindings, more particularly adapted to maintain the rear end of a boot on a ski.

A front abutment generally comprises a support element integral with the ski and an assembly comprising a body and a retention jaw, which assembly can pivot laterally relative to the ski, towards the right or towards the left, against elastic means defining the release threshold value of the binding. The front abutment assures the safety of the skier by responding, by virtue of its lateral release, to excessive torsional forces applied to the leg of the skier. An example of one such front abutment is described in French patent application No. 2 536 666.

Rear abutments, or heel members, generally comprise a jaw journalled on a body around a transverse axis to pivot between a retention position of the rear of the boot on the ski and a liberation position of the boot. The jaw is biased into the retention position of the boot by elastic means. One such rear abutment is described, for example, in French Patent Application No. 2 494 591, the disclosure of which is hereby incorporated by reference thereto. The rear abutments are generally disposed so as to slide for longitudinal adjustment and to be biased by springs to elastically maintain the abutment against the boot in the longitudinal direction.

Binding apparatus for monoskis generally comprise two assemblies of independent safety bindings, each comprising a front abutment and a rear abutment for the maintenance of a ski boot. Each of the binding pairs releases under the action of forces exerted by the boot inserted therein.

However, after the lateral or vertical release of a binding pair, the user's other foot remains attached to the monoski by the other binding pair. The forces applied to the leg still left attached to the monoski may become even greater, particularly because of the particularly wide shape of the monoski.

SUMMARY OF THE INVENTION

It is, therefore, an object of the invention to provide a binding which is adapted for use with monoskis.

According to the invention, an adaptor element is provided for a monoski safety binding comprising means for simultaneously releasing two ski boots from a binding system. The simultaneous release means comprises:

(a) first attachment means for releasably securing two first ski boot ends to the adaptor element; and (b) second attachment means for attaching the adaptor element to the ski by means of safety binding means whereby the adaptor element is configured to be inserted between the first ends of the two ski boots and a safety binding means to provide a safety binding whose release totally and simultaneously frees the two boots.

The first attachment means are adapted to releasably secure the two first ski boot ends side-by-side.

In one embodiment the first attachment means are stirrups in which the anterior ends of the ski boot soles are engaged. In this embodiment the second attachment means comprise an anterior edge having at least one portion of a shape corresponding to that of one anterior end of a standardized ski boot sole to engage in the jaws of at least one standardized front binding abutment.

The adaptor element may further comprise a posterior base plate integral with the first and second attachment means on which the intermediate portion of at least one of the ski boot soles is supported.

Additionally, the adaptor element may comprise means for guiding and resisting movement by the posterior portion of the adaptor element when only one of the boots is secured by the intermediate element. The guidance means may comprise a longitudinal central rib on the upper surface of the adaptor element against which the lower sides of the boots are supported.

Male-female nesting means may be provided between the lower surface of the adaptor element and the upper surface of the ski.

According to another embodiment of the invention, the second attachment means comprises two lateral front extensions each being configured to match with a standardized front abutment.

An an opening may be provided beneath the first attachment means to allow for the anterior portions of the boots to rest on a foot rest plate secured to a monoski.

An elastic means may be used for elastically securing the adaptor element to the monoski.

The adaptor may also comprise means for adjusting the relative lateral spacing of the front portions of the boots. The first attachment means may be stirrups each positioned to secure the two first ski boot ends, and the adjusting means is adapted to alter the relative lateral position of each of said stirrups. The stirrups are slidably mounted on the adaptor element, and the adjusting means may assume the form of an adjustment screw for adjusting the lateral position of the stirrups.

The adaptor may be used in combination with a ski brake having an active position in which it extends beneath the lower surface of the monoski, and an inactive position in which the ski brake is brought to the inactive position. Deactivation means may be provided for bringing the ski brake to the inactive position when one of the boots is inserted onto the adaptor element.

Viewed from a different perspective, the invention can be seen as a safety binding assembly in combination with the adaptor element of the invention.

BRIEF DESCRIPTION OF THE DRAWINGS

The invention will now be described with reference to the annexed drawings, given by way of non-limiting example only, in which.

DESCRIPTION OF PREFERRED EMBODIMENTS

Figure 1:
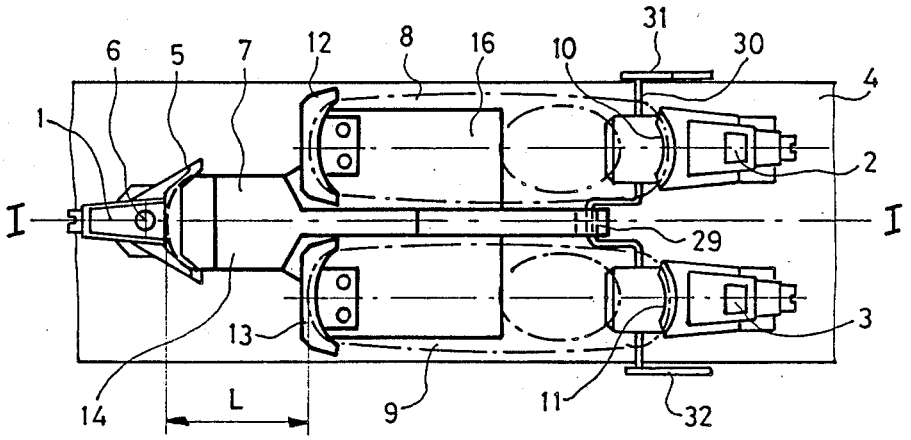
FIG. 1 illustrates a top view of a binding pair according to the invention.

The present invention has as an object to overcome the disadvantages of known safety apparatus when used in conjunction with monoskis. This is achieved by providing a novel binding structure for monoskis in which the liberation of one of the two boots during a lateral release automatically produces the liberation of the second boot, such that the two boots are simultaneously freed of the monoski and of all supplemental elements, and freed of one another as soon as the forces are sufficient to cause the release of the binding means retaining one of the boots.

The invention makes it possible in particular to assure the simultaneous release of the boots undergoing lateral torsion, without however modifying the operation of the rear abutments during a vertical force release.

According to another object of the invention, the means assuring the liberation of the second boot after release of the binding retaining the first boot are not incompatible with a use in which one attempts to maneuver the monoski by means of a single boot. For this, the invention provides means by which a single boot can remain fastened to the monoski, while undergoing normal constraints for normal operation, these constraints not causing the release of the safety bindings. Such a use is indispensible for use of the monoski while advancing on waiting lines of certain mechanical ski lifts.

According to the invention, conventional front and rear abutments are utilized. One thus avoids any modification of existing elements or use of special elements.

The invention furthermore makes it possible to provide a binding for monoskis in which the boot soles are not uselessly raised by raised portions which upset the stability of the assembly.

The binding according to the invention makes it possible to preserve the ease of boot insertion and removal, particularly at the rear abutments.

To achieve these objects as well as others, the invention provides for the use of an intermediate element which acts as an adaptor and is configured so as to be inserted between the first ends of the two ski boots and the safety bindings. The adaptor intermediate element comprises first attachment means for integrating side-by-side to the adaptor element two first ends of ski boots while nevertheless leaving the second ends of the boots free. The adaptor element comprises second attachment means for attaching the adaptor element to the ski by means of safety binding means. One thus achieves a safety binding whose release totally and simultaneously frees the two ski boots.

According to one embodiment, the first attachment means are stirrups in which the anterior ends of the soles of the ski boots engage from rear to front. The adaptor element comprises an anterior edge having at least one portion of a shape similar to that of an anterior end of the sole of a ski boot to engage in the jaws of at least one front safety binding abutment.

The adaptor element further comprises a posterior base plate integral with the attachment means, on which an intermediate portion of one and the other of the soles of the ski boots are carried. This arrangement prevents the buckling of the assembly formed by the shoe sole and the adaptor element.

Preferably, the safety binding set according to the invention comprises at least one anterior safety abutment cooperating with the adaptor intermediate element for the binding of the anterior ends of the boot sole, and two posterior safety abutments each assuring in a known fashion the binding of one posterior end of the boot sole.

FIGS. 1–4 illustrate a first embodiment of the safety binding pair for monoskis according to the invention.

This embodiment comprises a front central abutment 1, and two rear abutments 2 and 3 attached to the monoski 4 in a substantially symmetrical fashion with respect to the median longitudinal axis I—I of the monoski. Front abutment 1 is of the lateral release type, for example such as described in French Pat. No. 2 536 666, the disclosure of which is hereby incorporated by reference thereto, comprising a mobile jaw 5 which rotates around a vertical or oblique axis 6. Rear abutments 2 and 3 are conventional binding elements, for example of the type described in French Patent application No. 2 494 591, the disclosure of which is hereby incorporated by reference thereto, having vertical release, and elastic longitudinal sliding capability.

Figure 2:
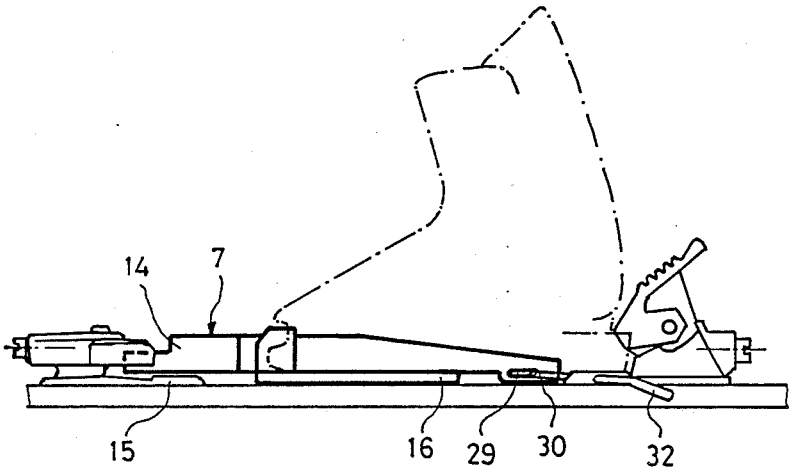
FIG. 2 is a side view of the apparatus of FIG. 1.

One adaptor intermediate element 7 is inserted between ski boots 8 and 9, shown in dashed lines in FIGS. 1 and 2, and anterior abutment 1. Adaptor intermediate element 7 is configured and positioned to assure the mechanical connection between the anterior abutment 1 and the anterior sides of boots 8 and 9. The posterior sides 10 and 11 of boots 8 and 9 are respectively engaged in the jaws of rear abutments 2 and 3. For this purpose, intermediate adaptor element 7 comprises first attachment means for receiving anterior portions of ski boot soles, and second attachment means for engagement in jaw 5 of anterior abutment 1 and cooperates with it during a lateral release. In the embodiment illustrated, the intermediate element is symmetrical with respect to the median longitudinal plane.

The first attachment means, in the embodiment shown in the Figs., are stirrups 12 and 13 in which the anterior end of soles of boots 8 and 9 engage from rear to front.

The second attachment means comprises a central anterior extension 14 extending in front of lateral stirrups 12 and 13 along a length L of a value sufficient to allow for the free passage of the stirrups behind jaw 5 of the anterior abutment during a lateral release. Extension 14, in the position of use, rests on foot rest plate 15 of anterior abutment 1.

In the safety bindings currently developed, the foot rest plate 15 is a pedal making it possible to adapt the release threshold of the anterior abutment 1 as a function of the support force exerted by the boot on plate 15. In the embodiment shown, intermediate adaptor element 7 transmits to the foot rest plate 15 the support force exerted by boots 8 and 9.

Extension 14 at its anterior end has the same shape as the shape of a standardized anterior end of a ski boot sole. It thus engages jaw 5 of the anterior abutment, and cooperates with this abutment in the same fashion as it would a boot during exertion of a lateral force.

Adaptor intermediate element 7 further comprises a posterior base plate 16 integral with the first and second attachment means on which is carried an intermediate portion of the soles of ski boots 8 and 9. Posterior base plate 16 prevents the upward pivoting of adaptor intermediate element 7, preventing the buckling of the assembly constituted by element 7 and the boot sole, between posterior abutments 2 and 3 and anterior abutment 1.

Figure 4:
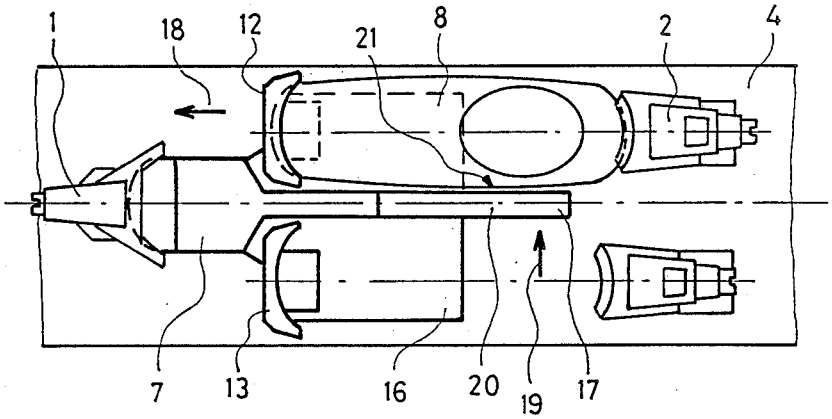
FIG. 4 illustrates a top view of the pair of FIG. 1 in the position of use with only a single ski boot inserted therein.

According to one particular embodiment shown in FIG. 4, adaptor intermediate element 7 further comprises means allowing for its use with a single ski boot 8. To this end, adaptor element 7 comprises means to guide its posterior portion 17 to avoid pivoting or lateral buckling when boot 8 is inserted in posterior abutment 2 and stirrup 12. In effect, in this position, the boot exerts on stirrup 12 a frontward force shown by arrow 18 producing a movement which tends to pivot the adaptor intermediate element 7 as shown by arrow 19. In the embodiment shown, the guidance means are constituted by a central longitudinal rib 20 provided on the upper surface of adaptor element 7 against which is carried the inner side 21 of boot sole 8, preventing the pivoting of element 7 in the direction of arrow 19.

According to another embodiment, the guidance of posterior portion 17 of element 7 can be assured by a male-female nesting between the lower surface of the adaptor element 7 and the upper surface of ski 4.

Figure 5:
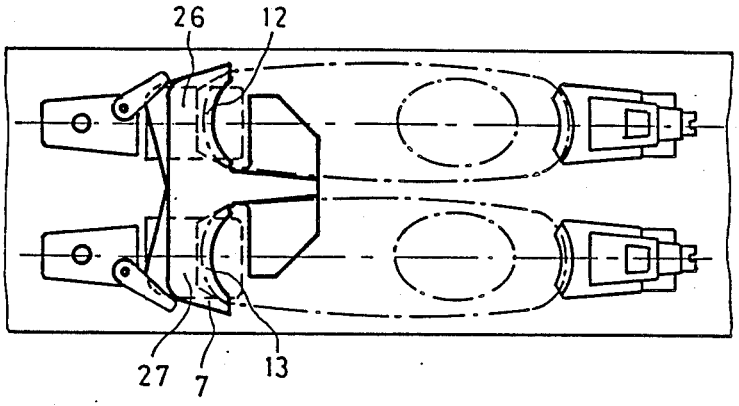
FIG. 5 illustrates a top view of a second embodiment of a binding pair according to the invention.
Figure 6:
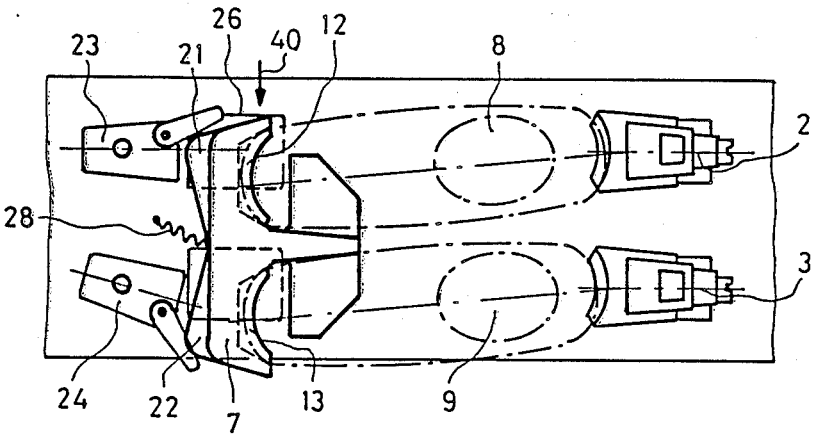
FIG. 6 illustrates a top view of the pair of FIG. 5 in the release position.
Figure 7:
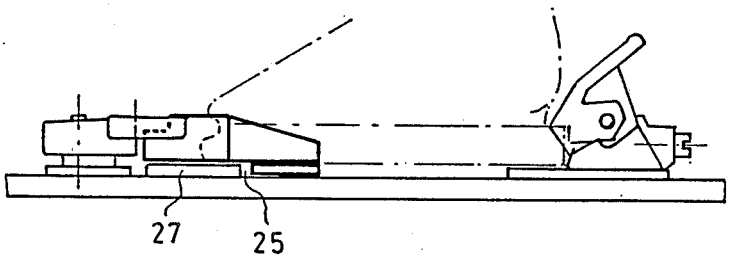
FIG. 7 illustrates a side view of the pair of FIG. 5.

The embodiment of FIGS. 5–7 has substantial advantages, particularly because it makes it possible to provide a shorter binding assembly. The zone occupied by the ski boot and the binding is generally more rigid than the rest of the ski, and thus interferes with the mechanical properties of the ski. One reduces the effects of this undesirable interference by providing a binding assembly which is as short as possible.

In this second embodiment, intermediate adaptor element 7 likewise has two anterior seats in the form of stirrup 12 and 13 to receive the anterior ends of boots 8 and 9. The posterior ends of boots 8 and 9 are engaged in the jaws of rear abutments 2 and 3.

The anterior end of adaptor intermediate element 7 comprises two lateral extensions 21 and 22, each substantially of a shape matching the anterior end of a standardized ski boot sole to respectively cooperate with first and second anterior abutments 23 and 24. The anterior abutments 23 and 24 can be of a conventional known type. It is however preferable to reduce the length of the assembly to eliminate the interior wings of the jaws of the two abutments or wings facing one another as shown in FIGS. 5 and 6. This elimination avoids, for example, the attachment of the adaptor intermediate element 7 by means of abutment 24 during a release. Anterior abutments 23 and 24 are symmetrically positioned on both sides of the longitudinal median axis I—I of the ski.

The lower portions of lateral extensions 21 and 22 comprise a cutout 25 which permits the soles of boots 8 and 9 to rest on foot rest plates 26 and 27, respectively, of anterior abutments 23 and 24.

In all of the embodiments, an elastic connection 28 connects the anterior portion of intermediate adaptor element 7 and ski 4 which tends to retain the intermediate element in the proximity of the ski. The pivoting allowed by elastic connection 28 must be sufficient to allow for release and liberation of boots 8 and 9.

In the embodiment shown in FIGS. 1–4, the apparatus further comprises means for limiting the spacing between the posterior portion 17 of the adaptor element and the ski 4.

According to this embodiment, posterior portion 17 of the adaptor intermediate element comprises an oblong slot 29 through which transverse shaft 30 controlling lateral braking elements 31 and 32 of the ski extends. In this manner, the braking element retains adaptor element 7 in the proximity of the ski, while adaptor element 7 itself controls the braking apparatus, raising braking elements 31 and 32 when the boots press intermediate element 7 against the ski. It should also be noted from the embodiment shown that the ski brake is rendered inactive as long as only one. boot is inserted in one of the bindings.

Figure 8:
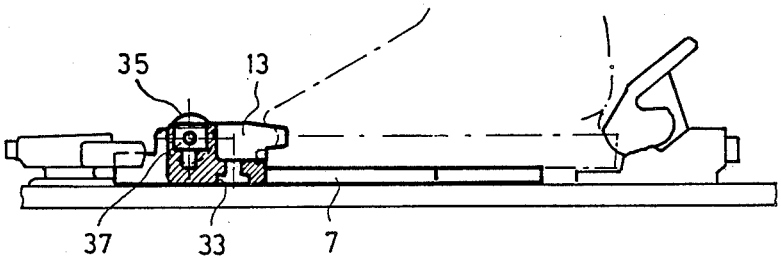
FIGS. 8 and 9 illustrate adjustment means for adjusting the spacing of the first attachment means.
Figure 9:
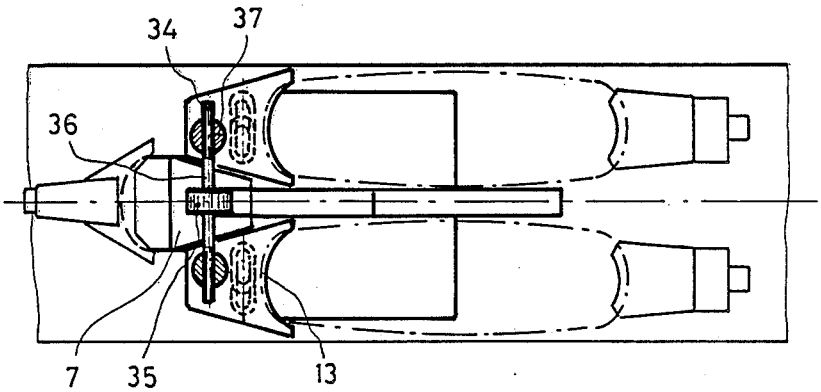

In the embodiment of FIGS. 1–4, the lateral anterior stirrups can have an adjustable spacing. FIGS. 8 and 9 illustrate one embodiment of the adjustment means, in which the stirrups such as stirrup 13 slide on slides 33 of the adaptor intermediate element 7, the spacing being adjusted by a screw 34 activated by an adjustment nut 35. Screw 34 swivels in a central bore 36 of the intermediate adaptor element 7, and comprises two threaded ends having reversed threads cooperating with tapped socket joints 37 integral with the stirrups.

Figure 3:
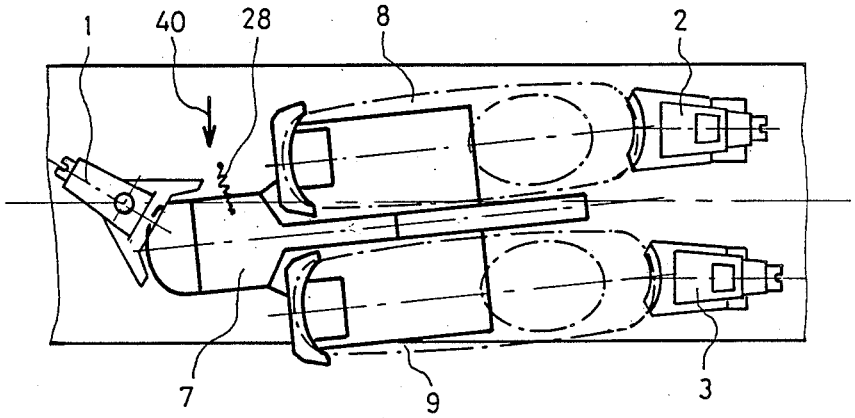
FIG. 3 illustrates a top view of the pair of FIG. 1 in the release position.

Operation of the apparatus is illustrated by FIGS. 3 and 6.

Under the effect of lateral forces, shown by arrow 40, ski boots 8 and 9 turn around a rear support point resulting from the action of posterior abutments 2 and 3, and the intermediate adaptor element 7 displaces laterally. In the embodiment of FIG. 3, intermediate element 7 undergoes a rotation, while the front abutment likewise turns. The anterior portion of the intermediate adaptor element 7 escapes from abutment 1, causing the simultaneous liberation of the two ski boots 8 and 9. The rear abutments 2 and 3 are preferably of a type allowing for an elastic longitudinal sliding to in part follow the differential movements of boots 8 and 9, and particularly the more substantial retraction of boot 9 in the Figure shown.

In the embodiment of FIG. 6, adaptor intermediate element 7' undergoes a transverse translational movement, remaining supported on the two anterior abutments 23 and 24. In this embodiment, the two boots 8 and 9 remain substantially parallel to one another and undergo the same retreat during the release.

Although the invention has been described with reference to particular means, materials and embodiments, it is to be understood that the invention is not limited to the particulars disclosed and extends to all equivalents within the claims.

What is claimed is:

1. Adaptor element for a monoski safety binding comprising:

(a) means for simultaneously releasing two ski boots from a binding system on the adaptor element; and (b) means for freeing both released boots relative to one another and relative to said adaptor element while freeing the adaptor element from the monoski.

2. The adaptor element as defined by claim 1 wherein said means of (a) and (b) comprise:

i. first attachment means for releasably securing two first ski boot ends to the adaptor element; and ii. second attachment means for attaching the adaptor element to the ski by means of a safety binding means whereby the adaptor element is configured to be inserted between the first ends of the two ski boots and the safety binding means to provide a safety binding whose release totally and simultaneously frees the two boots.

3. The adaptor element as defined by claim 2 wherein said first attachment means are adapted to releasably secure said two first ski boot ends side-by-side.

4. The adaptor element as defined by claim 3 wherein said first attachment means are stirrups in which said anterior ends of said ski boot soles are engaged.

5. The adaptor element as defined by claim 3 wherein said second attachment means comprise an anterior edge having at least one portion of a shape corresponding to that of one anterior end of a standardized ski boot sole to engage in the jaws of at least one standardized front binding abutment.

6. The adaptor element as defined by claim 2 further comprising a posterior base plate integral with said first and second attachment means on which the intermediate portion of at least one of said ski boot soles is supported.

7. The adaptor element as defined by claim 2 further comprising means for guiding and resisting movement by a posterior portion of said adaptor element when only one of said boots is secured by said intermediate element.

8. The adaptor element as defined by claim 7 wherein said guidance means comprises a longitudinal central rib on the upper surface of the adaptor element against which the lower sides of said boots are supported.

9. The adaptor element as defined by claim 2 further comprising male-female nesting means between the lower surface of the adaptor element and the upper surface of the ski.

10. The adaptor element as defined by claim 2 wherein said second attachment means comprises two lateral front extensions each being configured to match with a standardized front abutment.

11. The adaptor element as defined by claim 2 comprising an opening beneath said first attachment means to allow for the anterior portions of said boots to rest on a foot rest plate secured to a monoski.

12. The adaptor element as defined by claim 2 in combination with elastic means for elastically securing said adaptor element to said monoski.

13. The adaptor element as defined by claim 2 further comprising means for adjusting the relative lateral spacing of the front portions of said boots.

14. The adaptor element as defined by claim 13 wherein said first attachment means are stirrups each positioned to secure the two first ski boot ends, and wherein said adjusting means is adapted to alter the relative lateral position of each of said stirrups.

15. The adaptor element as defined by claim 14 wherein said stirrups are slidably mounted on said adaptor element.

16. The adaptor element as defined by claim 15 wherein said adjusting means comprises an adjustment screw for adjusting the lateral position of said stirrups.

17. The adaptor element as defined by claim 2 in combination with a ski brake having an active position in which it extends beneath the lower surface of said monski, and an inactive position in which said ski brake is brought to the inactive position.

18. The adaptor-ski brake combination as defined by claim 17 further comprising deactivation means for bringing said ski brake to the inactive position when one of said boots is inserted onto said adaptor element.

19. A safety binding assembly in combination with the adaptor element as defined by claim 1.

20. The safety binding assembly as defined by claim 19 comprising a single front binding adapted to receive and releasably secure the anterior portion of said adaptor element, and two rear bindings, said boots being held between first attachment means on the anterior portion of said adaptor element and said two rear bindings.

21. The safety binding assembly as defined by claim 20 wherein said simultaneous release means comprises:

(a) first attachment means for releasably securing two first ski boot ends to the adaptor element; and (b) second attachment means for attaching the adaptor element to the ski by means of said single safety binding whereby the adaptor element is configured to be inserted between the first ends of the two ski boots and a safety binding means to provide a safety binding whose release totally and simultaneously frees the two boots.

22. The safety binding assembly as defined by claim 21 wherein said first attachment means are adapted to releasably secure said two first ski boot ends side-by-side.

23. The safety binding assembly as defined by claim 22 wherein said first attachment means are stirrups in which said anterior ends of said ski boot soles are engaged.

24. The safety binding assembly as defined by claim 23 wherein said second attachment means comprise an anterior edge having at least one portion of a shape corresponding to that of one anterior end of a standardized ski boot sole to engage in the jaws of said front binding.

25. The safety binding assembly as defined by claim 24 further comprising a posterior base plate integral with said first and second attachment means on which the intermediate portion of at least one of said ski boot soles is supported.

26. The safety binding assembly as defined by claim 25 further comprising means for guiding and resisting movement by the posterior portion of said adaptor element when only one of said boots is secured by said intermediate element.

27. The safety binding assembly as defined by claim 26 wherein said guidance means comprises a longitudinal central rib on the upper surface of the adaptor element against which the lower sides of said boots are supported.

28. The safety binding assembly as defined by claim 19 further comprising male-female nesting means between the lower surface of the adaptor element and the upper surface of the ski.

29. The safety binding assembly as defined by claim 19 comprising two front bindings adapted to receive and releasably secure the anterior portion of said adaptor element, and two rear bindings, said boots being held between first attachment means on the anterior portion of said adaptor element and said rear bindings.

30. The safety binding assembly as defined by claim 29 wherein each of said two front bindings comprises a single outer binding jaw configured to releasably secure a front lateral extension, each of said front lateral extensions being configured to match with a standardized front abutment.

31. The safety binding assembly as defined by claim 19 wherein said adaptor element comprises an opening to allow for the anterior portions of said boots to rest on a foot rest plate secured to a monoski.

32. The safety binding assembly as defined by claim 19 in combination with elastic means for elastically securing said adaptor element to said monoski.

33. The safety binding assembly as defined by claim 20 further comprising means for adjusting the relative lateral spacing of the front portions of said boots.

34. The safety binding assembly as defined by claim 33 wherein said first attachment means are stirrups each positioned to secure the two first ski boot ends, and wherein said adjusting means is adapted to alter the relative lateral position of each of said stirrups.

35. The safety binding assembly as defined by claim 34 wherein said stirrups are slidably mounted on said adaptor element.

36. The safety binding assembly as defined by claim 35 wherein said adjusting means comprises an adjustment screw for adjusting the lateral position of said stirrups.

37. The safety binding assembly as defined by claim 20 in combination with a ski brake having an active position in which it extends beneath the lower surface of said monoski, and an inactive position in which said ski brake is brought to the inactive position.

38. The safety binding assembly as defined by claim 37 further comprising deactivation means for bringing said ski brake to the inactive position when one of said boots is inserted onto said adaptor element.

39. The safety binding assembly as defined by claim 20 in combination with a brake apparatus comprising braking elements, and wherein said adaptor element comprises an oblong slot through which a transverse shaft of said brake apparatus extends which controls the braking elements of the ski, whereby the braking apparatus retains the adaptor element and the adaptor element controls the braking apparatus.

40. The safety binding assembly as defined by claim 20 further comprising means to assure a permanent connection between the posterior portion of the adaptor element and the ski.

41. The safety binding assembly as defined by claim 20 wherein the adaptor element comprises a central anterior extension extending in front of lateral stirrups over a length allowing for the free passage of the stirrups to the rear of the front safety abutment during a lateral release, the central extension being adapted to rest on the foot rest plate of the front safety abutment.

42. Adaptor element for use with a monoski safety binding assembly comprising means for simultaneously releasing two ski boots as well as freeing both of said boots relative to one another, said binding assembly comprising a single front binding adapted to receive and releaseably secure the anterior portion of said adaptor element, and two rear bindings, said boots being held between first attachment means on the anterior portion of said adaptor element and said two rear bindings.

* * * * *

UNITED STATES PATENT AND TRADEMARK OFFICE

CERTIFICATE OF CORRECTION

PATENT NO. : 4,792,155

DATED : December 20, 1988

INVENTOR(S) : Bertrand BESNIER

It is certified that error appears in the above-identified patent and that said Letters Patent is hereby corrected as shown below:

At column 1, line 10, insert ——as—— after "known".
At column 2, line 29, change "An an" to ——An——.
At column 6, line 11, delete "." after "one".
At column 7, line 61, change "monski" to ——monoski——.
At column 10, line 25, change "releaseably" to ——releasably——.

Signed and Sealed this

Sixteenth Day of July, 1991

*Attest:*

*Attesting Officer*

HARRY F. MANBECK, JR.

*Commissioner of Patents and Trademarks*